US005265795A

United States Patent [19]

Roth et al.

[11] Patent Number: 5,265,795

[45] Date of Patent: Nov. 30, 1993

[54] FOOD CONTAINER FOR MICROWAVE OVEN HEATING

[76] Inventors: Peter Roth, 111 E. 14th St., Suite 251, New York, N.Y. 10003; Frank Lewkowitz, 87 Meridian Rd., Levittown, N.Y. 11756

[21] Appl. No.: 870,512

[22] Filed: Apr. 13, 1992

[51] Int. Cl.[5] ..... B65D 5/46

[52] U.S. Cl. ..... 229/117.22; 229/117.25; 229/910

[58] Field of Search ..... 229/117.19, 117.22, 229/117.23, 117.24, 117.25, 117.26, 910, 911, 912; 217/125; 220/94 R

[56] References Cited

U.S. PATENT DOCUMENTS

| | | | |
|---|---|---|---|
| 1,171,228 | 2/1916 | Misroch et al. | 229/117.22 |
| 1,707,528 | 4/1929 | La Bombard et al. | 229/117.26 |
| 3,012,706 | 12/1961 | Shinkle | 229/117.25 |
| 3,044,105 | 7/1962 | Wigemark | 229/117.24 |
| 3,373,924 | 3/1968 | Linda et al. | 229/117.24 |
| 3,677,459 | 7/1972 | Susuki et al. | 229/117.24 |
| 4,067,493 | 1/1978 | Stavin | 229/117.25 |
| 4,775,093 | 10/1988 | Lin | 229/117.25 |

FOREIGN PATENT DOCUMENTS

| | | | |
|---|---|---|---|
| 1344421 | 10/1963 | France | 229/117.25 |
| 1396064 | 3/1965 | France | 229/117.24 |
| 8201177 | 10/1983 | Netherlands | 220/94 R |
| 8904278 | 5/1989 | PCT Int'l Appl. | 229/117.24 |
| 1079442 | 8/1967 | United Kingdom | 229/117.26 |
| 1236241 | 6/1971 | United Kingdom | 229/117.26 |

*Primary Examiner*—Gary E. Elkins
*Attorney, Agent, or Firm*—Galgano & Belkin

[57] ABSTRACT

A food container of the type made of cardboard has a handle connected to the container, the handle being of plastic whereby the container can be safely heated in a microwave oven. The handle is flexible and has spaced fasteners, whereby the handle may secure the top of the container when the container is overfilled and the top flaps do not fold down flat.

2 Claims, 1 Drawing Sheet

FOOD CONTAINER FOR MICROWAVE OVEN HEATING

This invention relates to food containers and, more particularly to food containers which are made of cardboard and have a handle.

BACKGROUND

Food containers of the type used in Chinese restaurants and delicatessens have metal wire handles which are dangerous to insert in a microwave oven.

PRIOR ART

Prior art shows various containers, illustrated by the following patents:

U.S. Pat. No. 13,005
U.S. Pat. No. 1,707, 528
U.S. Pat. No. 1,931,329
U.S. Pat. No. 2,194,898
U.S. Pat. No. 2,272,462
U.S. Pat. No. 3,421,684

None of the prior patents shows Applicant's invention.

THE INVENTION

A food container of the type made of cardboard has a handle connected to the container, the handle being of plastic whereby the container can be safely heated in a microwave oven. The handle is flexible and has spaced fasteners, whereby the handle may secure the top of the container when the container is overfilled and the top flaps do not fold down flat.

OBJECTS OF THE INVENTION

A principal object of the invention is to provide a new and improved food container.

Another object of the invention is to provide a new and improved food container which can be safely heated in a microwave oven, the container having a plastic handle.

Another object of the invention is to provide a new and improved food container of the type made of cardboard, a handle connected to the container, the handle being of plastic whereby the container can be safely heated in a microwave oven.

These, and other objects of the invention will be apparent from the following specifications and drawings, of which, FIG. 1 is a side view of an embodiment of the invention.

Figure 1:
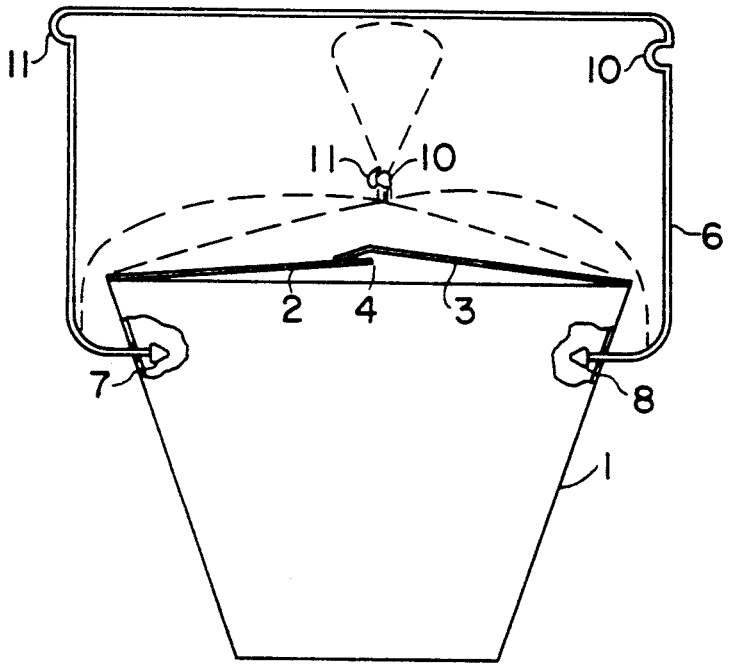

Referring to the drawings, the food container 1 is of the type currently used in delicatessens and Chinese restaurants to transport various types of food products. These containers are generally made of cardboard and some of them have a plastic coating. These containers can be of various sizes and shapes and generally have top flaps 2 and 3, which fold down and interlock to close the container.

There are also another pair of top flaps 4, and a corresponding flap on the other side (not shown in FIG. 1), which fold perpendicularly to the direction of flaps 2 and 3.

Figure 2:
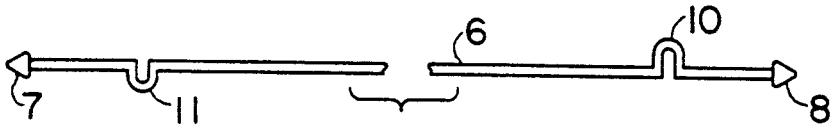
FIG. 2 is a detail view of the handle of the embodiment of FIG. 1.
Figure 3:
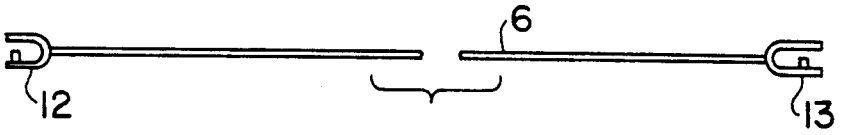
FIG. 3 shows a detail view of another handle embodiment.

The container has a handle 6, which in this embodiment is made of a flexible plastic strip. The handle is anchored in the sides of the container 1 by conventional means; for instance, the handle may have barbed ends 7 and 8 (FIG. 2), or it may have horseshoe type anchors 12 and 13, which lock into the side of the container.

Due to the fact that the handle 6 is plastic, the container may be safely heated in a microwave oven.

The handle 6 is flexible and has spaced snap fasteners 10 and 11 so that the handle may take the dotted line configuration in FIG. 1. The purpose of this is to secure the top of the container if the container is overfilled and the top flaps protrude upwardly.

We claim:

1. A food container of a type made of cardboard or plastic and having top flaps, an elongated handle member, the ends of the elongated handle member being connected to the container, the handle being of plastic, wherein the handle is flexible and has fasteners spaced in the central portion of the handle so that the handle may secure the top flaps of the container when the container is overfilled and the top flaps do not fold down flat, whereby the container can be safely heated in a microwave over.

2. A handle as in claim 1, wherein the handle is a flexible strip having two ends, spaced interlocking fasteners and ends-formed to anchor the ends of the handle in the container.

* * * * *